United States Patent [19]

Sukup

[11] Patent Number: 4,841,701

[45] **Date of Patent: * Jun. 27, 1989**

[54] DRYING BIN FLOORS

[76] Inventor: Eugene G. Sukup, Beeds Lake, Hampton, Iowa 50441

[ * ] Notice: The portion of the term of this patent subsequent to Aug. 12, 2003 has been disclaimed.

[21] Appl. No.: 84,692

[22] Filed: Aug. 12, 1987

[51] Int. Cl.[4] ..... E04B 1/70

[52] U.S. Cl. ..... 52/263; 52/192; 52/303; 52/588; 52/748

[58] Field of Search ..... 52/302, 303, 588, 536, 52/542, 145, 192, 579, 126.6, 263; 404/41, 36; 296/178

[56] References Cited

U.S. PATENT DOCUMENTS

| | | | |
|---|---|---|---|
| Re. 31,368 | 9/1983 | Trumper | 52/588 |
| 2,397,940 | 4/1946 | Benham . | |
| 2,901,960 | 9/1959 | Barre et al. . | |
| 3,324,616 | 6/1967 | Brown . | |
| 3,336,705 | 8/1967 | Vecchiarelli et al. . | |
| 3,643,607 | 2/1972 | MacKenzie . | |
| 3,675,379 | 7/1972 | Lambert et al. . | |
| 3,875,714 | 4/1975 | Nayler et al. . | |
| 4,009,520 | 3/1977 | Sukup . | |
| 4,073,110 | 2/1978 | Kennedy . | |
| 4,137,682 | 2/1979 | Trumper . | |
| 4,282,694 | 8/1981 | Mead . | |
| 4,557,086 | 12/1985 | Liefer | 52/302 |
| 4,604,842 | 8/1986 | Sukup | 52/303 |

FOREIGN PATENT DOCUMENTS 2366418 4/1978 France .

OTHER PUBLICATIONS

Advertising Literature Entitled "Channel-Lok Floor-s-Floor Support Systems", of S&H Mfg. Inc. of Nappanee, Indiana.

*Primary Examiner*—John E. Murtagh

*Attorney, Agent, or Firm*—Neuman, Williams, Anderson & Olson

[57] ABSTRACT

A supported floor of a grain storage and/or drying bin is disclosed that is constructed in part of conventional progressively interlocking asymmetrical floor panels and in part of either a single hat-shaped symmetrical panel, a single C-shaped symmetrical panel or a combination of these latter panels. Methods of assembling such floors are also disclosed including methods of assembly from the transverse center line of the base of the bin with the use of a centrally located hat-shaped panel or a C-shaped between two hat-shaped panels. C-shaped panels are included whenever access to the plenum is desired. In all such assemblies, asymmetrical conventional panels are used.

19 Claims, 2 Drawing Sheets

DRYING BIN FLOORS

BACKGROUND OF THE INVENTION

Field of the Invention

This invention relates to supported bin floors and particularly to improved sheet metal perforate panel floors such as are used for false floors above plenums in grain bins.

Floors which are used in grain storage bins are oftentimes elevated and supported above a base of the bin thereby creating a plenum between the base and the supported floor. The supported floor has perforations through it so that air which may be heated or ambient, can be passed from outside the bin into the plenum and up through the perforations in the floor for passage through overlying grain. The air may be used to dry, cool or otherwise condition overlying grain in the bin, e.g., to prevent subsequent spoilage of the grain. Such bins may serve as drying bins for continuous or batch drying and/or for longer term storage.

Supported bin floors generally include a plurality of longitudinal panels of uniform width cut to appropriate lengths and arranged side-by-side to substantially cover the entire floor area of the bin, e.g., as shown in U.S. Pat. No. 4,009,520. In a common commercial design of these panels, sold under the trademark CHANNEL-LOK owned by Sukup Manufacturing Company, one variant of which is disclosed in U.S. Pat. No. 4,073,110, a plurality of similar floor panel sections each have inwardly turned male and outwardly turned female flanges of U-shaped cross sections along opposite edges of the panel so that the male flange of one panel section can be positioned and interlocked within the female flange of an adjacent floor panel section; see also FIGS. 5, 6A and 6B of my U.S. Pat. No. 4,604,842 and the related description therein. Floor supports are distributed throughout the plenum, subtend the panels and often engage the outside of the female flanges. In one embodiment the floor supports are substantially "Z" shaped in cross section. In another embodiment as shown in U.S. Pat. No. 4,073,110, the supports used have outwardly diverging sides with recesses cut into the upper end of both sides so that the engaged flanges can be received therein. Another form of available support is shown in said U.S. Pat. No. 4,604,842. Other forms of supports are also available, including blocks placed on the base of the bin and onto which are placed the engaged flanges of the floor sections.

The disclosure in U.S. Pat. No. 4,604,842 for Drying Bin Floor, issued to me, is incorporated herein by reference. As referred to in that patent, one key problem with supported perforate floors in grain bins is that fine materials such as chaff, broken kernels and the like in the grain being stored and/or dried tend to sift through the perforations in these floors with successive uses and collect in the plenum. Such sifting and filling is accelerated in bins which use bottom unloading augers for continuous drying. These augers continuously move or "work" the grain near the supported floor, and incidentally enhance the sifting action. This can result in substantially filling the plenum with fines over a relatively short period, e.g., in as little as one season of use with the floors described above. The accumulation of fines obviously interferes with the air flow desired.

It has been found that such fines often accumulate at a substantially higher rate near the center of the bin. This may be due to the fact that the grain typically is discharged into the bin at the center. In any event, procedures for attempting to clean out the plenum without removing the floor where conventional flooring is used have proven unsatisfactory.

Another problem with conventional floor panels relates to the assembly and disassembly of the floor system. In particular, with conventional panels, it is necessary to install the floor from one side of the bin and move progressively across the bin to the opposite side. It is not possible with such flooring to begin installation near the center of the bin and move outwardly therefrom. Similarly, with the conventional floors of panels which are of the same configuration and progressively interlocked, typically it is necessary to disassemble and remove the entire floor to gain adequate access for cleaning or otherwise working in the entire area of the plenum around the many supports. Such process is time consuming and expensive.

U.S. Pat. No. 4,604,842 discloses interlocking perforated flooring comprising panels of two designs, alternately positioned, each with a plank portion and subjacent flanges. The first panel design has flanges at both edges which are outwardly turned to form a hat-shaped transverse cross section. The second panel design has channels at both edges which are inwardly turned resulting in a C-shaped transverse cross section. The hat-shaped panels are rested on supports which are arranged on the base of the bin in a predetermined manner with the hat-shaped panels positioned in spaced relation to one another so that a C-shaped panel can be fit therebetween. Thereafter, the C-shaped panels are positioned in the respective spaces and interlocked with the respective outwardly turned channels of the adjacent hat-shaped panels. As a result, any of the C-shaped panels thereafter can be lifted without affecting the hat-shaped panels.

Floor panels of these various cross-sectional shapes typically are produced on roll forming machines having progressive dies. A different machine or at least a different set of dies is required for each different panel shape to be produced. However, these machines are very expensive to acquire or to modify to produce a different shape of floor panel. Many current floor manufacturers have existing equipment to produce the conventional uniform progressive floor panels. Thus, it is desirable to gain the benefits of the use of the hat-shaped and C-shaped panels in bin floors while retaining the use of conventional progressive panels.

It has been found that when using the removable panel floor system described above, it is not necessary to gain access to the plenum at every alternate panel. Also, it would be beneficial if only a select number of C-shaped and hat-shaped panels were interspersed in such floor systems in integration with the conventional panels. Moreover, it would be useful to have supported floor systems where the floor can be assembled from the center of the bin and/or disassembled from the center or other selected segments of the bin floor.

It is an object of this invention to provide a supported grain bin floor system which will satisfy the aforenoted requirements and meet the particular needs for perforated floors in grain storage bins.

It is an object of this invention to provide supported grain bin floors which utilize progressively interlocked floor panels and also provide ready access therethrough to a subjacent plenum at selected locations.

It is another object of this invention to provide a supported grain bin floor which can be disassembled at its center and at selected other areas of the bin to gain access to the underlying space and any accumulated material therein.

It is another object of this invention to provide a supported grain bin floor system which can be assembled beginning at the center of the bin and moving outwardly toward the walls.

It is yet another object of this invention to provide a supported grain bin floor system which includes conventional progressive floor panels and that can be used in conjunction with the hat-shaped and C-shaped floor panels disclosed in U.S. Pat. No. 4,604,842 with support posts of uniform configuration to stabilize the resulting elevated floor and maintain it in its designed state.

Further and additional objects of this invention will appear from the following description, accompanying drawings and appended claims.

SUMMARY OF THE INVENTION

In accordance with a preferred embodiment of this invention a supported floor of a grain storage and/or drying bin is constructed in part of conventional progressively interlocking asymmetrical floor panels and in part of either a single hat-shaped symmetrical panel, a single C-shaped symmetrical panel or a combination of the latter panels.

In one illustrative embodiment of this invention, a hat shaped panel is positioned above the transverse center line (diameter) of the base of the bin and the remainder of the floor is formed of conventional panels except that a hat-shaped panel C-shaped panel combination is included in predetermined locations where access to the plenum will be required. Assembly of such a supported floor with a hat-shaped initial panel at its center and selected symmetrical panels proceeds by resting said central hat-shaped panel on supports which are arranged on the base of the bin in a predetermined manner along the transverse center line of the bin. Conventional floor panels which also are supported can then be attached progressively on each side of this initial panel until coming to the locations where ready access is desired. A C-shaped panel and hat-shaped panel combination is inserted at each such location, i.e., a hat-shaped panel is spaced accordingly from the preceding conventional panel and the C-shaped panel is inserted in that space. Laying of conventional panels then proceeds from the outwardly extending flange of the hat-shaped panel.

In another embodiment of this invention, a conventional floor is installed in the conventional manner with the exception that a combination of C-shaped and hat-shaped panels is substituted for two conventional panels wherever access to the plenum of the bin is desired. In yet another embodiment the center start aspect of this invention can be employed where the hat-shaped panel is first supported along the center line of the bin and conventional flooring is then installed throughout the remainder of the bin. In another embodiment, a C-shaped panel is at the center of the bin between two hat-shaped panels to which, in turn series of conventional panels are attached. In a further embodiment, conventional panels are assembled from opposite walls, progressively toward the center, where a single C-shaped panel is installed to gain access to the plenum.

With any of the above combinations, conventional progressively interlocking flooring such as that sold under the trademark CHANNEL-LOK can be used in conjunction with C-shaped floor panels, which provide access to the plenum, and hat-shaped panels, which enable the bin floor to be built from the center or near the center of the bin out to opposing walls.

DESCRIPTION OF THE DRAWINGS

For a more complete understanding of this invention, reference should be made to the embodiments illustrated in greater detail in the accompanying drawings and described below by way of example of the invention.

It should be understood that the drawings are not necessarily to scale and that an embodiment is sometimes illustrated in part by schematic and fragmentary views. In certain instances, details of the actual structure which are not necessary for an understanding of the present invention may have been omitted. It should be understood, of course, that the invention is not necessarily limited to the particular embodiments illustrated herein.

DETAILED DESCRIPTION

Figures 1, 2, 7, 8:
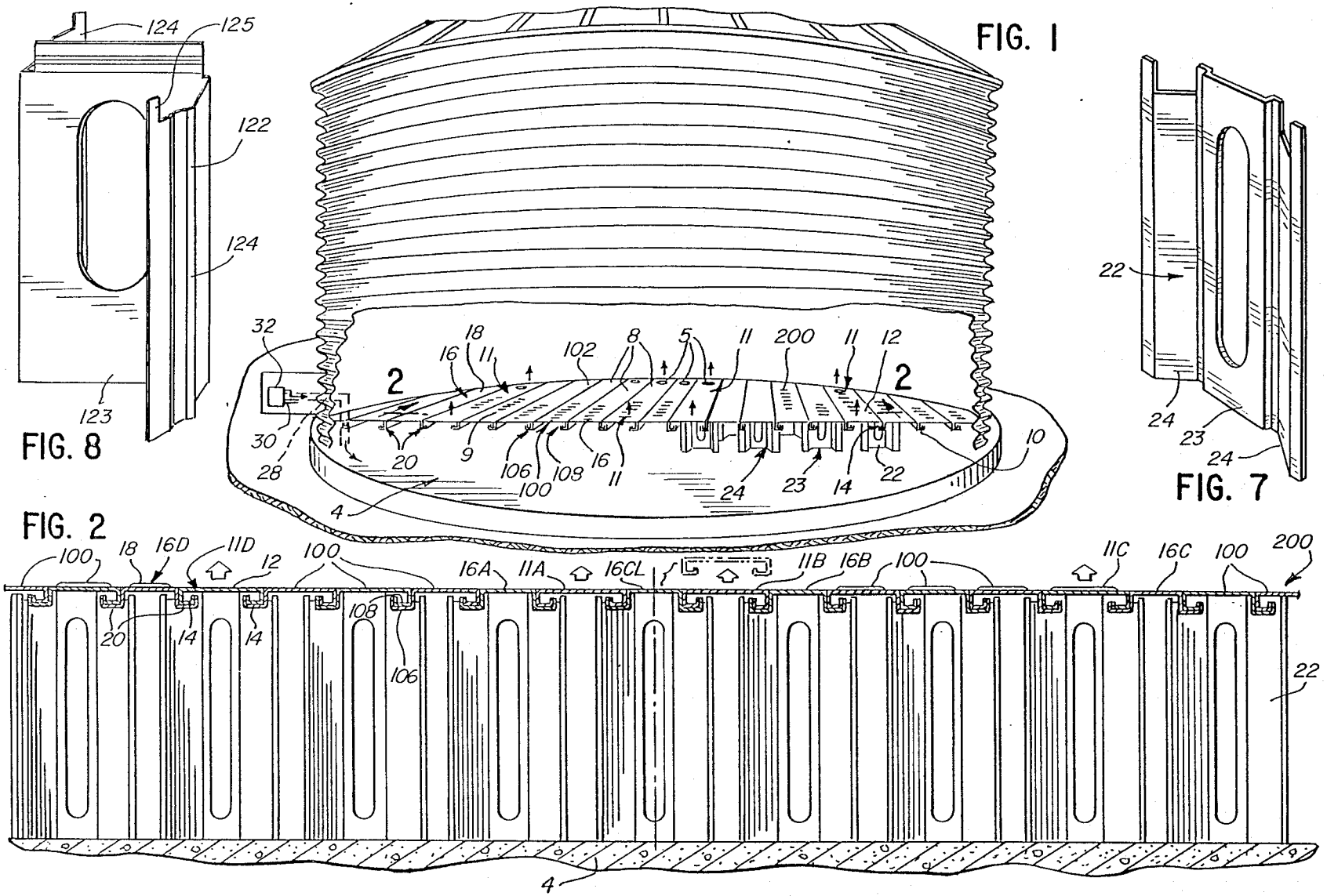
FIG. 1 is a schematic partial perspective view, partially in section, of one embodiment of a supported floor in a grain bin and embodying teachings of this invention where several C-shaped and hat-shaped floor panels have been ineegrated with conventional progressively interlocked flooring such that controlled access can be gained to the base of the bin, with a central hat-shaped panel.
FIG. 2 is a partial sectional view of the supported floor system shown in FIG. 1 as taken along line 2—2.
FIG. 7 is a perspective view of a support post of the assembly of FIGS. 1 and 2.
FIG. 8 is a perspective view of a support post of the assemblies of FIGS. 3–6.

FIG. 1 illustrates a partial perspective view of a cylindrical grain bin 2 having a concrete base floor 4 and a circular wall 6, typically formed of corrugated sheet metal, with a supported grain bin floor system 200 of this invention. This grain bin floor system 200 as well as the other embodiments of grain floor systems which are the subject of this invention are typically formed of sheet metal. The supported floor system shown in FIG. 1 includes three designs of floor panels 8 each having perforations 9 (punch perforated or slit perforated) to provide for the passage of conditioning air, e.g., drying and/or cooling air. This air can be conveyed into the bin by a fan 30, which may include a heater 32 located outside the bin, and enters the bin through a porthole 28. The air passes into the plenum 10 below the panels 8 and up through the perforations into and through grain (not shown) stored in the bin on the supported floor system 200. A gripping notch or opening 5 can be formed near the end of each panel 8, particularly in the C-shaped panels, for engagement by a gripping tool or means (not shown) to align or lift the desired panel 8. Such openings are either small enough to prevent leakage of grain therethrough or may be provided with readily removable covers. As shown in FIG. 1 but also in FIGS. 2 and 7, floor supports 22 each having a central panel portion 23 and diverging sides 24 subtend the panels of the floor system 200. A preferred support 122 which is substantially "Z" shaped in cross-section is shown in FIGS. 8 and 3–6. These supports are discussed in greater detail below.

The floor system 200 shown in FIG. 1 includes three designs of panels 8, that is, asymmetrical conventional floor panels 100 such as those currently sold under the trademark CHANNEL-LOK by Sukup Manufacturing Company and two designs of symmetrical panels, namely, C-shaped panels 11 and hat-shaped panels 16. The latter are of the configurations disclosed in the aforementioned U.S. Pat. No. 4,604,842. Each conventional panel 100 has a plank portion 102 and two subtending channel flanges, one outwardly turned as at 106 and the other inwardly turned as at 108. Each C-shaped panel 11 has a central panel plank portion 12 and uniform inwardly turned channel flanges 14 running longitudinally along the opposite sides of the plank portion 12. Each hat-shaped panel 16 has a central panel plank portion 18 and uniform outwardly turned channel flanges 20 running longitudinally along the opposite sides of the plank portion 18. The inwardly turned channel flanges of the panels are of uniform size and configuration to snugly interlock into the outwardly turned flanges of any other panel. The latter flanges also are uniform from panel to panel.

When the span between the outer edges of each panel, i.e., the conventional panels, the hat-shaped panels and the C-shaped panels are substantially uniform, each can be accommodated by a standard floor support; see said U.S. Pat. No. 4,604,842.

A combination of one C-shaped panel and one hat-shaped panel occupies the same space and has the same external channel configuration as a pair of interconnected conventional panels and thus can be substituted for two conventional floor panels 100. As a result, wherever ready access to the plenum of a bin is desired, a hat-shaped panel and C-shaped panel combination can be substituted for two conventional panels in a floor otherwise formed of conventional panels. Also, the access opening provided by simply lifting out a C-shaped panel can be enlarged by progressive removal of conventional panels on the side of the resulting opening remote from the hat-shaped panel.

As shown in U.S. Pat. No. 4,604,842, the inwardly turned flanges 14 of the C-shaped panel 11 are designed to be snugly fit into the outwardly turned channels 20 of the hat-shaped panels such that adjacent panels are interlocked. Likewise, the inwardly turned channels 14 of C-shaped panels 11 are designed to be snugly held by the outwardly turned channels 106 of conventional floor panels 100 and the outwardly turned channels 20 of the hat-shaped panels 16 are designed to accommodate the inwardly turned channels 108 of the conventional floor panels 100. As a result and as shown in FIGS. 2–6, various combinations of the hat-shaped panels 16, C-shaped panels 11 and conventional panels 100 can be used in a grain bin such that the interlocking channels are beneath the planes of the central plank portions of the various types of panels to form a continuous, essentially planar supported floor surface. The channels effectively form support beams. At the same time, access can be gained to the base of the bin 4 by lifting any of the C-shaped panels 11 and contiguous conventional panels on one side as noted above.

Furthermore, a bin floor can be constructed from its transverse center (diameter) outwardly by either (a) starting with a hat-shaped panel positioned above the center-line of the base of the bin or (b) starting with a pair of hat-shaped panels positioned on opposite sides of the center-line of the base of the bin and positioning a C-shaped panel therebetween such that it is over the center line. In either instance the floor can then be constructed outwardly from the center with conventional panels. Wherever access to the plenum of the bin is desired, a combination of a hat-shaped panel and a C-shaped panel can be substituted for two conventional panels.

Construction from the center outward permits placing of the longest panels first and then installing the progressively shorter panels required for a round bin floor. This is as distinguished from normal usage of conventional panels which requires that assembly begin at one side with the shortest panel. Also this center initiation facilitates selective disassembly of either side portion of the floor.

Before further discussing the versatility of the resulting floor systems with the C-shaped panels 11 and hat-shaped panels 16 in combination with conventional floor panels 100, two floor supports 122, 22 which can be used in conjunction with these floor panels are described. In particular as shown in FIGS. 8 and 3–6, a preferred floor support 122 can be used that is substantially "Z" shaped in cross section including a diagonal portion 123 and opposing sides 124. As shown in FIG. 8, each opposing side 124 is cut along its top portion such that a tab 125 is formed at its outer end. Each side 124 is bent at an angle with respect to the diagonal portion 123. As a result, a recess is formed between the inside edge of this tab and the corresponding outside edge of the diagonal 123. Consequently, the outwardly turned channels 20, 106 of hat-shaped panels 16 and conventional panels 100 can be accommodated in this recess. Notches (not shown) can be cut out of the inside edge of one of the tabs and the corresponding outside edge of the diagonal to form respective lips. When the support is fitted with the channel, these tabs can be fit over the portion of the outside channels 20, 106 that are not continuous with the panel portions to assist in holding the support 122 in place. Another support is shown in FIGS. 1, 2 and 7. This floor support 22 has a central panel portion 23 and diverging sides 24. Each diverging side 24 has a recess in the top portion to accommodate the outwardly turned channels 20, 106 of hat-shaped panels 16 or conventional floor panels 100. These supports 22, like the preferred supports 122, are designed to always engage the outer channel of each nested pair of channels. The top segment of the diagonal portion 123 and the central panel portion 23 of each support 122, 22 extends upward between the respective adjacent pair of the channels to provide direct support for the respective panel plank portions 12, 18, or 102. It should be understood that other floor supports can be used with the various floor panel combinations described herein.

It should be further understood that the C-shaped panels 11 and hat-shaped panels 16 may be of any desired width. However, it is desirable that all panels be of such a width as to be accommodated by the same supports as are used for the conventional floor panels 100. This is particularly desirable here where C-shaped panels 11 and hat-shaped panels 16 substitute for conventional floor panels 100. In a preferred embodiment, each of the panels is formed from a blank of the same width. As a result, the outside dimension of the C-shaped, hat-shaped and conventional panels will vary and some modification to the supports may be necessary to accommodate these various panels. Alternatively, if the supports used cannot be modified or are not desired to be modified, all panels can be made having the same outside dimensions. The means by which the width of hat-shaped panels 16 and C-shaped panels 11 can be made uniform and have the same outside dimension as conventional panels 100 is disclosed in U.S. Pat. No. 4,604,842.

A variety of applications of these floor panels in combination with conventional floor panels in a grain storage bin will now be described. In particular, FIG. 2 shows a side view of the supported grain bin floor system 200 illustrated in FIG. 1 along line 2—2. A central hat-shaped panel 16CL is supported along the center line of the base 4 of the bin 2. C-shaped panels 11A, 11B are adjacent the central hat-shaped panel 16CL and hat-shaped panels 16A, 16B are adjacent the C-shaped panels 11A, 11B. Conventional panels 100 are disposed progressively outward from each of the hat-shaped panels 16A, 16B with the exception that two more pairs of hat-shaped and C-shaped panels 11C, 16C, 11D, 16D are installed in selected spaced locations where ready access through the floor is desired. With this design, selective access can be gained to the underlying plenum 10. That is, C-shaped panels 11A–11D can be lifted to gain access to the base of the bin. Second, with the use of a hat-shaped panel 16CL along the transverse center line of the base 2, the floor can be constructed from the center of the bin progressively outward. Finally, with this floor design 200, conventional asymmetrical floor panels 100 can be used and it is necessary to provide only a few symmetrical C-shaped panels and hat-shaped panels as opposed to an entire flooraassembly of such panels.

Figure 3:
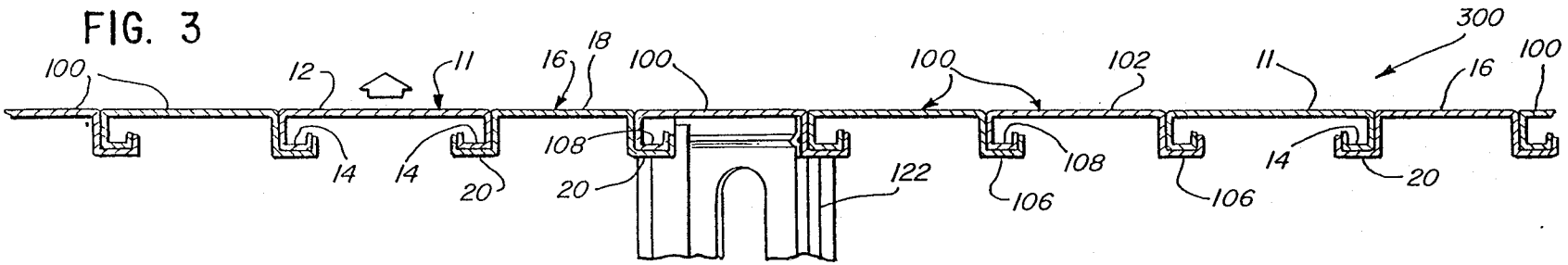
FIG. 3 is a sectional view of another embodiment of a supported bin floor system embodying teachings of this invention where C-shaped floor panels and hat-shaped floor panels are used with conventional flooring.

FIG. 3 shows a side view of another supported grain bin floor system 300 where spaced combinations of hat-shaped panels 16 and C-shaped panels 11 are integrated with conventional floor panels 100. Wherever a combination of said panels 11, 16, occurs access can be gained to the plenum through the grain bin floor. As discussed above, the pair of C-shaped and hat-shaped panels is of the same width as two conventional panels and has the same outer-channel configuration as an interconnected pair of conventional panels. Therefore, in effect, they replace two conventional panels in a floor assembly.

Figure 4:
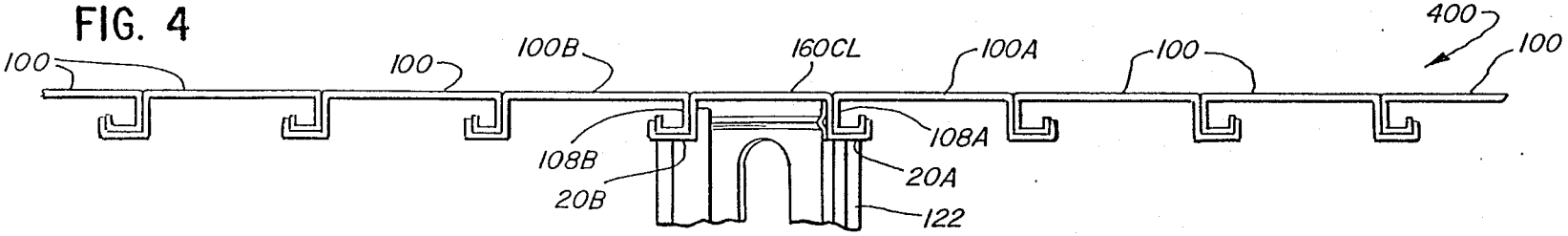
FIG. 4 is a sectional view of yet another embodiment of a supported bin floor system embodying teachings of this invention where the center start method of installation with a hat-shaped floor panel has been employed.

FIG. 4 illustrates a side view of another supported grain bin floor system 400 where a hat-shaped panel 16CL has been supported proximate the transverse center line of the grain bin floor and conventional floor panels 100 are attached thereto in sequence over the remainder of the plenum of the bin. In particular, one series of conventional panels beginning with a first conventional floor panel 100A is attached to the central hat-shaped panel 16CL by inserting the inwardly turned channel 108A of the first conventional channel 100A into the first outwardly turned channel 20A of the hat-shaped panel 16CL. A second series of conventional panels begins with a second conventional panel 100B which is attached to the central hat-shaped panel 16CL at its other outwardly turned channel 20B. With this design, the supported bin floor can be assembled beginning at the center of the bin and moving outwardly with conventional panels.

Figure 5:
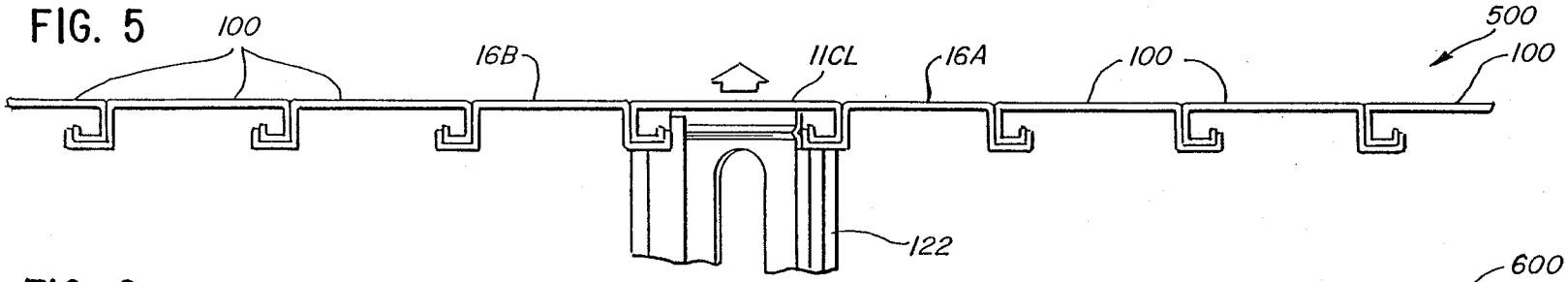
FIG. 5 is a sectional view of another embodiment of a supported floor panel system embodying teachings of this invention where two hat-shaped floor panels have been used with a C-shaped floor panel therebetween proximate the center line of the bin and conventional floor panels are used throughout the remainder of the floor.

Another supported grain bin floor system 500 is illustrated by the side view in FIG. 5. In that system, a C-shaped panel 11CL is positioned proximate the transverse center line of the base of the bin and is engaged with two respective hat-shaped panels 16A, 16B. Conventional floor panels 100 are then attached to the respective hat-shaped panels 16A and 16B in a series until an entire supported grain bin floor is formed. With such a system 500, the advantages of building a floor from substantially near its center outwardly are met. In addition, the ability to gain access to the plenum beneath the center of the floor, the area where the largest volume of fines generally accumulates, is possible.

Figure 6:
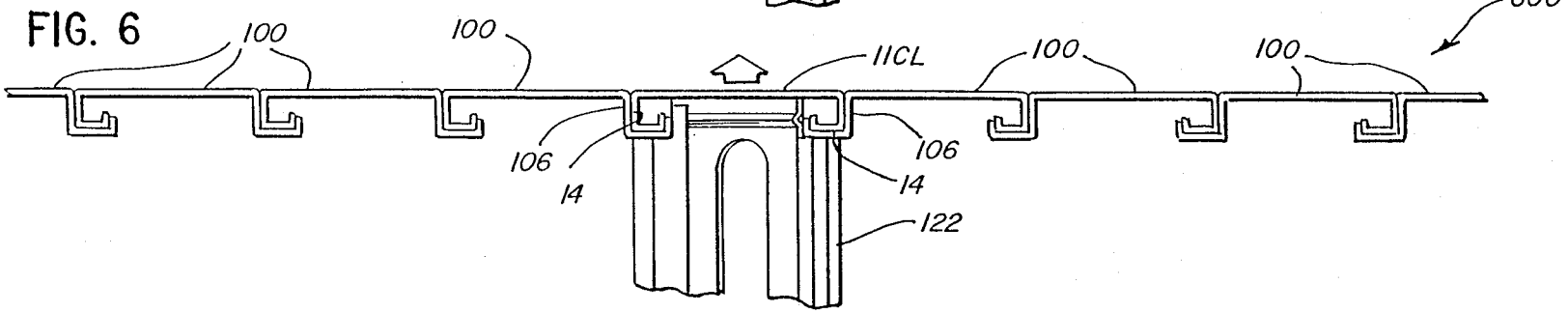
FIG. 6 is a side view of another embodiment of this invention where a C-shaped panel is positioned proximate the center line of the base of the bin and conventional flooring is used elsewhere.

A side view of another floor system 600 is shown in FIG. 6. With this system 600, a central C-shaped panel 11CL is used so that access can be gained to the base of the bin along its center line and conventional floor panels are used across the remainder. In addition, the constructed floor can be disassembled from the center of the bin, although the floor must be assembled progressively from opposing side walls.

The various supported grain bin floor systems of this invention as illustrated in FIGS. 2–6 can be readily assembled, but the method of assembly will vary with the precise configuration desired. For instance, with respect to the floor system 200 illustrated in FIG. 2, a preferred method of assembly comprises placing a number of support posts on the concrete base floor 4 of the portion of the bin where the center line hat-shaped panel 16CL is to be positioned. Additional support posts can be placed on the concrete base floor wherever supports are needed. It should be noted that while a support never directly engages the inwardly turned channels 14 of the C-shaped panels 11, a support can be placed therebelow as it will engage either the outwardly turned channel 20 of a hat-shaped panel or the outwardly turned channel 106 of a conventional panel 100. These supports are staggered along the lengths of adjacent panels and typically are spaced about 36 inches from one another along the length of each panel.

Referring again to the specific system 200 shown in FIGS. 1 and 2, before installing the C-shaped panels 11A, 11B adjacent to the center hat-shaped panel 16CL, it is necessary to install the adjacent hat-shaped panels 16A, 16B such that a space is allotted between the central hat-shaped panel 16CL and the respective adjacent hat-shaped panels 16A, 16B such that the C-shaped panels 11A, 11B can be fitted therebetween. The appropriate spacing is assured by the use of supports of appropriate width spanning between the adjacent hat-shaped panels 16CL, 16B and 16CL, 16A. A slight amount of pressure may be necessary to seat the C-shaped panels and make the adjacent plank portions flush with each other depending on the tightness of the fit of the interlocked panels and flanges. Once this set of panels is in place, additional supports can be set up and the conventional flooring can be installed. At each selected location where additional C-shaped panels 11C, 11D and hat-shaped panels 16C, 16D occur, the hat-shaped panels 16C, 16D are positioned before installing adjacent C-shaped panels 11C, 11D.

For installation of the floor system shown in FIG. 3, support posts 122 can be placed in the bin along the area where the first hat-shaped panels will be installed. Before installing the adjacent C-shaped panels 11, the adjacent conventional panels are installed at the appropriate spaced positions.

For the system shown in FIG. 4, where no C-shaped panels are employed, the first set of supports 122 can be placed along the center line of the concrete base floor 4, and the hat-shaped panel 16CL is positioned thereover. Supports 122 and conventional panels 100 are assembled in sequence on each side, with the in-turned flanges of the initial conventional floor panels 100 being internested in the outwardly extending flanges of the panel 16CL, as shown.

The installation of the floor panel system 500 shown in FIG. 5 is similar to the methods of installation described above with the exception that it is necessary to install adjacent hat-shaped panels 16A and 16B on opposite sides of the center line of the bin floor 4 before installing the C-shaped panel 11CL. The remainder of the floor can then be installed as described above.

As noted earlier, installation of the system 600 shown in FIG. 6 is accomplished by progressively interlocking sub-series of the conventional panels 100 from opposing sides of the bin such that they approach one another at the center. Each set of opposing panels 100 is assembled with the outwardly turned channels 106 positioned towards the center of the bin. At the center, a single C-shaped panel 11CL is then installed whereby the opposing outwardly turned channels 106 of opposing conventional panels 100 are interlocked with the inwardly turned channels 14 of the C-shaped panel 11CL.

It should be noted that the supported grain bin floors disclosed herein need not be installed from the center of the bin. Rather installation can occur from any area where either a hat-shaped panel 16 is installed or from the side of the bin.

Because the supports 22, 122 engage only the hat-shaped panels 16 or conventional panels 100, the floor remains stable and the spacing between the adjacent panels is maintained whenever the C-shaped panels are lifted to gain access to the plenum. Similarly, the removed or lifted C-shaped panel can be easily replaced. Moreover, the supports in the space of a removed C-shaped panel can be removed by slightly lifting or tilting the adjacent hat-shaped panels to free the intervening supports. If necessary, conventional panels can be lifted and the underlying supports removed by removing the nearest C-shaped panel and any intervening conventional panels. Hat-shaped panels can be most easily removed by removing the closest C-shaped panels on either side and removing any intervening conventional panels. Other methods of disassembling the floor system disclosed herein can be used depending upon the particular components desired to be lifted or removed. The applicant has described the above methods to illustrate a preferred mode of gaining access to the plenum beneath the various flooring systems.

Thus various embodiments of drying bin floors which use floor panels to facilitate gaining access to the plenum therebelow, which can be constructed from the center of the bin and which can be used with conventional floor panels has been disclosed, which meets the aforestated objects of this invention.

While specific embodiments of the invention have been shown, it should be understood, of course, that the invention is not limited thereto since modifications may be made and other embodiments of the principles of this invention will occur to those skilled in the art to which this invention pertains. Therefore, it is contemplated by the appended claims to cover any such modifications and other embodiments as incorporate those features of this invention within the true spirit and scope of the following claims.

What is claimed is:

1. A perforate grain bin floor assembly for a supported floor having a space therebeneath comprising a series of elongated panels of formed sheet material, each of said panels having a generally planar top portion and depending flanges along each longitudinal edge of said top portion, said top portions of successive panels in said series being perforate to permit the passage of air therethrough and being adapted for disposition contiguous to one another along said longitudinal edges of said top portions, said series comprising at least one symmetrical panel wherein both of said flanges thereof extend inwardly or outwardly and a plurality of asymmetrical panels each having a first of said depending flanges extending outwardly along one edge and a second of said depending flanges extending inwardly along the opposite edge, said series including a panel along each edge of said symmetrical panel, and an inwardly extending flange of one of said panels engaging in nesting relation with a respective outwardly extending flange of a contiguous panel at each joint between contiguous panels in said series whereby said top portions form a generally continuous planar floor surface while permitting the passage of air therethrough.

2. The invention as in claim 1 including at least one hat-shaped symmetrical panel having outwardly extending flanges and one C-shaped symmetrical panel having inwardly extending flanges in contiguous relation with one another within said series whereby said C-shaped panel may be selectively removed from the assembled series of said panels for access to the space subjacent such assembled panels.

3. The invention as in claim 1 including at least one hat-shaped symmetrical panel having outwardly extending flanges for disposition proximate the transverse center line of such an assembly and at least two subseries of asymmetrical panels for internesting connection with each of said outwardly extending flanges of said hat-shaped panel and with one another to progressively form floor assembly portions outward from each side of said hat-shaped panel.

4. In a bin for storing or drying grain and having a base floor with a transverse center line, a supported floor assembly comprising the combination of a plurality of support posts each having a bottom portion positioned on said base floor and each having a top portion spaced from said base floor; series of interconnected panels each having a panel plank portion which is perforate for the passage of air therethrough, two longitudinal edges and a depending channel subjacent to each of said longitudinal edges; said series comprising at least one symmetrical panel wherein both of said flanges thereof extend inwardly or outwardly and a plurality of asymmetrical panels each having a first of said depending flanges extending outwardly along one edge and a second of said depending flanges extending inwardly along the opposite edge, and said series including a panel along each edge of said symmetrical panel, and an inwardly extending flange of one of said panels engaging in nesting relation with a respective outwardly extending flange of a contiguous panel at each joint between contiguous panels in said series; each of said outwardly turned channels contacting the top portion of a plurality of said support posts and said panel plank portions being contiguous to one another along said longitudinal edges whereby said panels form a generally continuous planar floor surface permitting passage of air therethrough for conditioning grain.

5. The invention of claim, 4 wherein a symmetrical panel of said series is positioned proximate the transverse center line of the base floor of said bin.

6. The invention as in claim 4 including at least one hat-shaped symmetrical panel having outwardly extending flanges disposed proximate the transverse center line of said bin and at least two sub-series of asymmetrical panels in internesting connection with each of said outwardly extending flanges of said hat-shaped assembly portions outward from each side of said hat-shaped panel.

7. The invention as in claim 4 including at least one hat-shaped symmetrical panel having outwardly extending flanges and one C-shaped symmetrical panel having inwardly extending flanges in contiguous relation with one another within said series whereby said C-shaped panel may be selectively removed from the assembled series of said panels for access to the space subjacent such assembled panels.

8. In a bin for storing or drying grain and having a base floor with a transverse center line, a supported floor assembly comprising the combination of:

a plurality of support posts each having a bottom portion positioned on said base floor and each having a top portion spaced from said base floor;

a hat-shaped panel having a panel plank portion which is perforate for the passage of air therethrough, two longitudinal edges and an outwardly turned depending channel subjacent to each of said longitudinal edges;

a C-shaped panel having a panel plank portion which is perforate for the passage of air therethrough, two longitudinal edges and an inwardly turned depending channel subjacent to each of said longitudinal edges; and at least one assymmetrical panel having a panel plank portion which is perforate for the passage of air therethrough, two longitudinal edges, an inwardly turned depending channel subjacent to a first of said longitudinal edges and an outwardly turned depending channel subjacent to a second of said longitudinal edges;

wherein the outwardly turned channels of the hat-shaped panel contact the top portions of a plurality of said support posts, said C-shaped panel is positioned adjacent said hat-shaped panel and has its first inwardly turned channel in interfitting relation with an outwardly turned channel of the hat-shaped panel and the outwardly turned channel of said assymmetrical panel contacts the top portion of a plurality of said supports and is positioned in interfitting relation with the second inwardly turned channel of the C-shaped panel such that said panel plank portions are contiguous to one another along said longitudinal edges whereby said panels form a generally continuous planar floor surface permitting passage of air therethrough for conditioning grain and said C-shaped panel can be lifted to gain access to the space between said panels and said base floor.

9. The invention of claim 8 wherein said hat-shaped panel is positioned above the center line of the base floor of said bin.

10. The invention of claim 8 wherein said C-shaped is positioned above the center line of the base floor of said bin.

11. In a bin for storing or drying grain and having a base floor with a transverse center line, a supported floor assembly comprising the combination of:

a plurality of support posts each having a bottom portion positioned on said base floor and each having a top portion spaced from said base floor.

a C-shaped panel having a panel plank portion which is perforate for the passage of air therethrough, two longitudinal edges and an inwardly turned depending channel subjacent to each of said longitudinal edges;

first and second hat-shaped panels each having a panel plank portion which is perforate for the passage of air therethrough, two longitudinal edges and an outwardly turned depending channel subjacent to each of said longitudinal edges; and at least one assymmetrical panel having a panel plank portion which is perforate for the passage of air therethrough, two longitudinal edges, an inwardly turned depending channel subjacent to a first of said longitudinal edges and an outwardly turned depending channel subjacent to a second of said longitudinal edges;

wherein the outwardly turned channels of said panels contact the top portions of a plurality of said support posts, said first and second hat-shaped panels are positioned adjacent said C-shaped panel along its longitudinal edges, said hat-shaped panels each have one of their outwardly turned channels in interfitting relation with an inwardly turned channel of the C-shaped panel, and said assymmetrical panel is positioned adjacent one of said hat-shaped panels and has its inwardly turned channel in interfitting relation with the second outwardly turned channel of said hat-snaped panel such that said panel plank portions are contiguous to one another along said longitudinal edges whereby said panels form a generally continuous planar floor surface permitting passage of air therethrough for conditioning grain and said C-shaped panel can be lifted to gain access to the space between said panels and said base floor.

12. The invention of claim 11 wherein said C-shaped panel is positioned above the center line of the base floor of said bin.

13. In a bin for storing or drying grain and having a base floor with a transverse center line, a supported floor assembly comprising the combination of:

a plurality of support posts each having a bottom portion positioned on said base floor and each having a top portion spaced from said base floor;

a C-shaped panel having a panel plank portion which is perforate for the passage of air therethrough, two longitudinal edges and an inwardly turned depending channel subjacent to each of said longitudinal edges; and first and second assymmetrical panels each having a panel plank portion which is perforate for the passage of air therethrough, two longitudinal edges, one inwardly turned depending channel subjacent to a first of said longitudinal edges and one outwardly turned depending channel subjacent to a second of said longitudinal edges;

wherein the outwardly turned channels of said first and second assymmetrical panels contact the top portions of a plurality of said support posts, said first and second conventional panels are each positioned adjacent said C-shaped panel along its longitudinal edges, and said assymmetrical panels each have their outwardly turned channel in interfitting relation with the respective inwardly turned channel of said C-shaped panel such that said panel plank portions are contiguous to one another along said longitudinal edges whereby said panels form a generally continuous planar floor surface permitting passage of air therethrough for conditioning grain and said C-shaped panel can be lifted to gain access to the space between said panels and said base floor.

14. The invention of claim 13 wherein said C-shaped panel is positioned above the center line of the base floor of said bin.

15. A method of constructing a supported perforate grain bin floor in a grain bin having a base floor with a transverse center line comprising:

positioning a plurality of support posts in a predetermined manner on the base floor of the bin proximate said center line;

providing at least one hat-shaped panel having a panel plank portion which is perforate to permit the passage of air therethrough, two longitudinal edges and an outwardly turned edge channel subjacent to each of said longitudinal edges;

positioning said hat-shaped panel on said support posts along said center line; and progressively assembling a series of panels from each of the longitudinal edges of said hat-shaped panel outward to the respective side of said bin, including interlocking the first panel of each such series with the edge channel of said hat-shaped panel and interlocking each successive panel with the preceding channel in said series.

16. A method of constructing a supported perforate grain bin floor in a grain bin having a base floor with a transverse center line comprising:

positioning a plurality of support posts in a predetermined manner on the base floor of the bin;

providing at least two panels each having a panel plank portion which is perforate to permit the passage of air therethrough and having two longitudinal edges, and each of said panels having an outwardly turned channel subjacent to at least one of said longitudinal edges;

positioning said two panels over said support posts and in substantially parallel relation to each other and to said center line with respective outwardly turned channels thereof opposing each other and spaced at a predetermined distance from each other proximate said center line;

providing a C-shaped panel having a panel plank portion which is perforate to permit the passage of air therethrough, having two longitudinal edges and having an inwardly turned channel subjacent to each of said longitudinal edges;

positioning said C-shaped panel between said spaced first and second panels and interfitting one of said inwardly turned channels of said C-shaped panel into the adjacent outwardly turned channel of said first panel and the second of said inwardly turned channels of said C-shaped panel into the adjacent outwardly turned channel of the second panel with said panel plank portions contiguous to one another along said longitudinal edges of said panel plank portions thereof; and progressively assembling a series of panels from each of the outwardly disposed longitudinal edges of said two hat-shaped panels outward to the respective side of said bin, interlocking the first panel of each such series with the respective edge channel of said two hat-shaped panels and interlocking each successive panel with the preceding channel in said series, whereby said panel plank portions form a generally continuous planar floor surface permitting the passage of air therethrough for conditioning grain and said C-shaped panel can be lifted to gain access to the space subjacent said bin floor without lifting of the panels.

17. A method of constructing a supported perforate grain bin floor with panels in a grain bin having a base floor comprising:

positioning a plurality of support posts in a predetermined manner on the base floor of a bin;

providing at least one assymmetrical panel having a panel plank portion which is perforate to permit the passage of air therethrough, two longitudinal edges, an outwardly turned channel subjacent to one of said longitudinal edges and an inwardly turned channel subjacent to the other of said longitudinal edges;

positioning said assymmetrical panel over said support posts;

providing at least one hat-shaped panel having a panel plank portion which is perforate to permit the passage of air therethrough, two longitidinal edges and an outwardly turned channel subjacent to each of said longitudinal edges;

positioning said hat-shaped panel over said support posts in substantially parallel relation to said assymmetrical panel with one of said outwardly turned channels of said hat-shaped panel opposing said outwardly turned channels of said assymmetrical panel and spaced therefrom at a predetermined distance;

providing a C-shaped panel having a panel plank portion which is perforate to permit the passage of air therethrough, having two longitudinal edges and an inwardly turned channel subjacent to each of said longitudinal edges; and positioning said C-shaped panel between said spaced hat-shaped panel and assymmetrical panel and interfitting one of said inwardly turned channels of said C-shaped panel into the adjacent outwardly turned channel of said hat-shaped panel and the second of said inwardly turned channels of said C-shaped panel into the adjacent outwardly turned channel of the assymmetrical panel with said panel plank portions contiguous to one another along said longitudinal edges of said panel plank portions thereof, whereby said panel plank portions form a generally continuous planar floor surface permitting the passage of air therethrough ror conditioning grain and said C-shaped panel can be lifted to gain access to the space subjacent said bin floor without lifting of the panels.

18. The invention of claim 17 further comprising:

providing at least one additional assymmetrical panel;

positioning said additional assymmetrical panel over said support posts adjacent said hat-shaped panel and interfitting the inwardly turned channel of said additional assymmetrical panel into the remaining outwardly turned channel of said hat-shaped panel.

19. The method of assembling a supported floor in a grain bin and providing selective access through said floor at a predetermined location comprising:

providing asymmetrical floor panels each having parallel longitudinal edges with a depending inwardly turned channel along one of said edges and a depending outwardly turned channel along the other of said edges capable of receiving such an inwardly turned channel of another such panel in interesting relation therein;

providing at least two symmetrical floor panels having parallel longitudinal edges, including a first panel having a depending inwardly turned channel along each of said edges thereof and a second panel having depending outwardly turned channels along each of said edges thereof capable of receiving such inwardly turned channels of the other of said panels in internesting relation therein;

assembling a series of said asymmetrical panels in progressive interlocking relation with one another to form a portion of said supported floor and providing an exposed outwardly turned channel of one of said asymmetrical panels along one edge of said floor portion;

assembling a combination of said first and second symmetrical panels along said one edge with one of said inwardly turned channels of said first panel engaged in said exposed outwardly turned channel along said one edge and the other of said inwardly turned channels thereof engaged in one of the outwardly turned channels of said second symmetrical panel whereby said first panel thereafter may be removed by lifting it from its assembled relation in said floor, and providing an exposed outwardly turned channel of said second symmetrical panel, and assembling a second series of said asymmetrical panels in interlocking relation with said exposed outwardly channel of said second symetrical panel.

* * * * *

UNITED STATES PATENT AND TRADEMARK OFFICE

CERTIFICATE OF CORRECTION

PATENT NO. : 4,841,701

DATED : June 27, 1989

INVENTOR(S) : Eugene G. Sukup

It is certified that error appears in the above-identified patent and that said Letters Patent is hereby corrected as shown below: Title page:

In the 10th line of the Abstract, after C-shaped add --panel--.

Col. 7, line 47, correct the spelling of "floor assembly."

Claim 6, Col. 11, line 19, after "hat-shaped" insert --panel and with one another to progressively form floor --.

Claim 10, Col. 12, line 6, after "C-shaped," insert --panel--.

Claim 11, Col. 12, line 43, correct "hat-snaped" to read --hat-shaped--.

Claim 13, Col. 13, line 7, correct " conventional" to read -- assymmetrical--.

Claim 17, Col. 14, line 36, correct the spelling of "longitudinal."

Claim 17, Col. 14, line 63, "ror" should read --for --.

Claim 19, Col. 15, line 17, correct "interesting" to read --internesting--.

Signed and Sealed this

Fourteenth Day of August, 1990

*Attest:*

*Attesting Officer*

HARRY F. MANBECK, JR.

*Commissioner of Patents and Trademarks*